US008282246B2

(12) United States Patent
Quadri et al.

(10) Patent No.: US 8,282,246 B2
(45) Date of Patent: Oct. 9, 2012

(54) STAGE LIGHT FIXTURE AND METHOD FOR CONTROLLING SAID LIGHT FIXTURE

(75) Inventors: Pasquale Quadri, Torre De'Roveri (IT); Angelo Cavenati, Brusaporto (IT)

(73) Assignee: Clay Paky S.p.A., Seriate (IT)

( * ) Notice: Subject to any disclaimer, the term of this patent is extended or adjusted under 35 U.S.C. 154(b) by 451 days.

(21) Appl. No.: 12/638,802

(22) Filed: Dec. 15, 2009

(65) Prior Publication Data

US 2010/0157603 A1 Jun. 24, 2010

(30) Foreign Application Priority Data

Dec. 16, 2008 (IT) ..... MI2008A2233

(51) Int. Cl.
*F21V 17/02* (2006.01)
*F21S 8/00* (2006.01)

(52) U.S. Cl. ..... 362/277; 362/268; 362/319

(58) Field of Classification Search ..... 362/277, 362/278, 280, 281, 318, 319, 320, 449, 512, 362/268, 285, 239, 270, 391, 401, 388
See application file for complete search history.

(56) References Cited

U.S. PATENT DOCUMENTS

| | | | | |
|---|---|---|---|---|
| 2,905,806 A | | 9/1959 | Tunney | |
| 4,519,020 A | * | 5/1985 | Little | 362/268 |
| 4,519,021 A | * | 5/1985 | Oram | 362/277 |
| 6,220,727 B1 | | 4/2001 | Chang | |
| 7,394,057 B2 | * | 7/2008 | Goto et al. | 362/277 |
| 8,002,439 B2 | * | 8/2011 | Cavenati et al. | 362/268 |
| 2005/0052872 A1 | | 3/2005 | de Peralta | |

FOREIGN PATENT DOCUMENTS

EP 1452800 A2 9/2004

OTHER PUBLICATIONS

Italian Search Report dated Jun. 25, 2009 as issued in Italian Application No. IT MI2008A 002233 filed on Dec. 16, 2008.

* cited by examiner

*Primary Examiner* — Bao Q Truong
(74) *Attorney, Agent, or Firm* — Workman Nydegger

(57) ABSTRACT

A stage light fixture is provided with:
- a main body extending along a longitudinal axis;
- a light source arranged inside the main body at a first end of the main body and suitable to emit a light beam substantially along the longitudinal axis;
- an objective lens arranged at a second end of the main body;
- light beam adjusting means, which are arranged between the light source and the objective lens for intercepting the light beam;
- a frame;
- a carriage which is movable with respect to the frame along the longitudinal axis of the main body, and supports the light beam adjusting means;
- at least a first power cable to power at least a first electric device mounted on the carriage; and
- a compensation device suitable to keep the first power cable under tension for each working position of the carriage.

12 Claims, 3 Drawing Sheets

STAGE LIGHT FIXTURE AND METHOD FOR CONTROLLING SAID LIGHT FIXTURE

BACKGROUND OF THE INVENTION

One type of stage light fixture is known, comprising a main body extending along a longitudinal axis; a light source arranged inside the main body at a first end of the main body and suitable to emit a light beam substantially along the longitudinal axis; an objective lens arranged at a second end of the main body; light beam adjusting means which are arranged between the light source and the objective lens for intercepting the light beam; a frame; and a carriage which is movable with respect to the frame along the longitudinal axis of the main body, and supports the light beam adjusting means.

The light beam adjusting means are suitable to obtain particular effects on the light beam, and generally comprise beam coloring and modeling assemblies, lenses, diaphragms, etc.

In addition to the adjusting means, the carriage also supports the respective electric motors for actuating and moving the adjusting means, e.g. the motor for rotating the gobo holder plate, the motor for moving the diaphragm, the lenses, etc.

Each electric motor needs to be powered by a respective power cable. Therefore, the total number of power cables which lead to the carriage is rather high. Furthermore, the power cables need to be long enough not to limit the carriage movements along the longitudinal axis.

The number and length of the power cables determine the appearance of some drawbacks.

Indeed, the power cables easily intertwine thus limiting the carriage movements along the longitudinal axis and furthermore often occupy the spaces of maneuvering the carriage, obstructing the movement thereof.

SUMMARY OF THE INVENTION

It is an object of the present invention to provide a stage light fixture which is free from the drawbacks of the prior art illustrated herein; in particular, it is an object of the present invention to provide a light fixture which allows to overcome the above-mentioned drawbacks in a simple, cost-effective manner, from both the functional and constructional points of view.

In accordance with these objects, the present invention relates to a stage light fixture comprising:

- a main body extending along a longitudinal axis;
- a light source arranged inside the main body at a first end of the main body and suitable to emit a light beam substantially along the longitudinal axis;
- an objective lens arranged at a second end of the main body;
- light beam adjusting means which are arranged between the light source and the objective lens for intercepting the light beam;
- a frame;
- a carriage which is movable with respect to the frame along the longitudinal axis of the main body, and supports the light beam adjusting means; and
- at least a first power cable to power at least a first electric device mounted on the carriage;

the light fixture being characterized by comprising a compensation device suitable to keep the first power cable under tension for each working position of the carriage.

It is a further object of the invention to provide a method for controlling a light fixture aimed at avoiding the emphasized problems of the prior art.

In accordance with these objects, the present invention relates to a method for controlling a stage light fixture provided with a main body extending along a longitudinal axis, comprising the steps of:

moving a carriage with respect to a fixed frame of the main body along the longitudinal axis of the main body;

powering at least a first electric device mounted on the carriage by means of at least a first power cable;

the method being characterized by comprising the step of keeping the first power cable under tension.

BRIEF DESCRIPTION OF THE DRAWINGS

Further features and advantages of the present invention will be apparent from the following description of non-limiting embodiments, with reference to the figures in the accompanying drawings, in which.

DETAILED DESCRIPTION OF THE INVENTION

Figure 1:
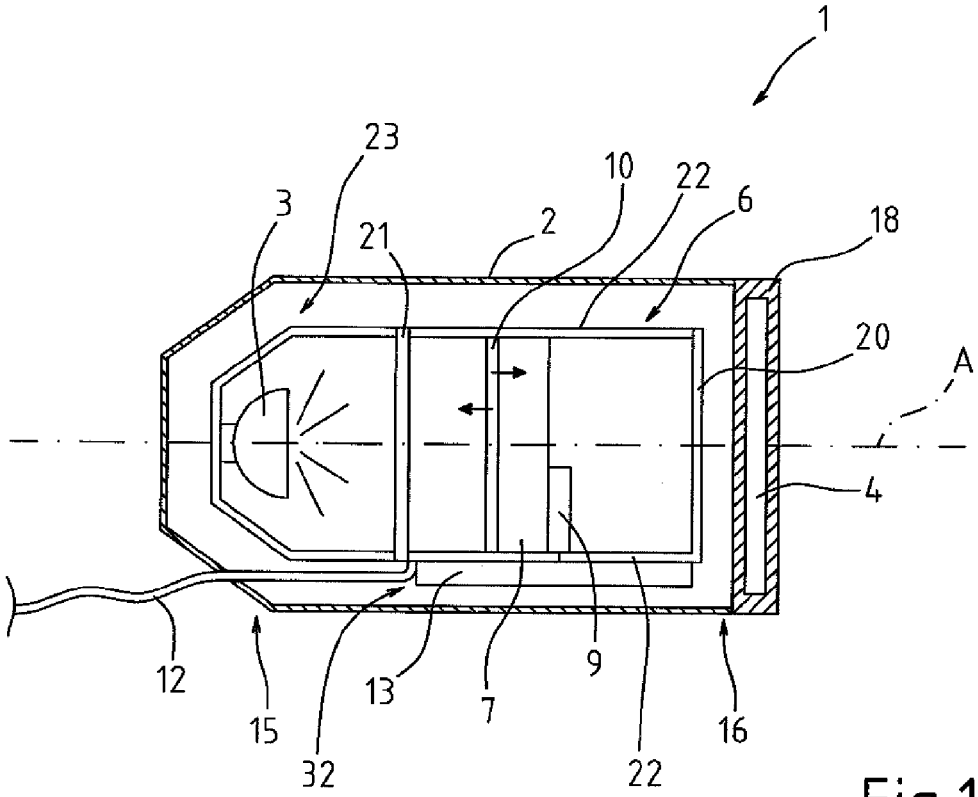
FIG. 1 is a diagrammatic top view, with parts in section and parts removed for clarity, of a stage light fixture provided according to the present invention.

In FIG. 1, reference number 1 indicates a stage light fixture comprising a main body 2, a light source 3, an objective lens 4, a frame 6, light beam adjusting means 7, electric devices 9, a carriage 10, a power cable 12 and a compensation device 13.

The main body 2 is hollow and is substantially elongated in shape. It extends along a longitudinal axis A and has a first end 15 and a second end 16 opposite to the first end 15 along the axis A.

The light source 3 is arranged within the main body 2 at the first end 15 of the main body 2 and is suitable to emit a light beam substantially along the axis A.

The objective lens 4 is preferably circular and is fixed to the second end 16 of the main body 2 so as to be centered on the axis A. In particular, the objective lens 4 is supported by a supporting ring 18, which is fixed to the main body 2.

Frame 6 is arranged within the main body 2 and comprises a plate 20, arranged at the second end 16 upstream of the objective lens 4 along the axis A, a plate 21 arranged between the light source 3 and the first plate 20, and two side plates 22 connected to the plate 20 and to the plate 21 and parallel to the axis A.

Plates 20 and 21 are arranged orthogonally to the axis A and are perforated so as to allow the light beam to pass. Plates 20 and 21, and side plates 22 are preferably made of metal material.

In the case of the non-limiting example described and illustrated here, frame 6 comprises a supporting structure 23 connected to plate 21 for supporting the light source 3.

The adjusting means 7 (diagrammatically shown in FIG. 1 as a single member) comprise members suitable to obtain particular effects on the light beam, e.g. light beam filtering and/or modeling effects. The adjusting means 7 may comprise a diaphragm, a fixed gobos assembly, a rotating gobos assembly, lenses, a light beam coloring assembly, etc. (not shown for simplicity), for example.

The electric devices 9 (diagrammatically shown for the simplicity in FIGS. 1 and 2 by a single member) are powered by the power cable 12 and comprise electric motors (not shown) for actuating and moving the light beam adjusting means 7.

Carriage 10 is supported by frame 6 and is movable with respect to frame 6 along the axis A between a first distal position with respect to the light source 3, in which carriage 10 is close to plate 20, and a proximal position with respect to the light source 3, in which carriage 10 is close to plate 21.

In the case illustrated here, carriage 10 is a preferably metal plate, arranged orthogonally to axis A, provided with a hole (not visible in the accompanying drawings) for passing the light beam, and having a substantially quadrangular shape. In the case described and illustrated herein, carriage 10 slides with respect to frame 6 along respective guides of frame 6 (not shown for simplicity).

Carriage 10 supports the light beam adjusting means 7 so that the adjusting means 7 are arranged between the light source 3 and the objective lens 4 for intercepting the light beam.

Carriage 10 also supports the electric devices 9.

In the non-limiting case described herein, carriage is moved by means of an electric motor with belt transmission (not shown for simplicity) supported by frame 6.

In a variant of the present invention (not shown), carriage 10 is moved by one or more electric worm motors supported by carriage 10 and also powered by the power cable 12.

The power cable 12 comprises one or more electric conductors electrically insulated from one another, suitable to power respective electric devices 9. In the case of the non-limiting example described and illustrated herein, the power cable 12 comprises four electric conductors electrically insulated from one another and coupled to one another to form a conductive tape.

The compensation device 13 (diagrammatically shown in FIG. 1 as a single member) is suitable to keep the power cable 12 under tension so as to avoid the power cable 12 from obstructing the movement of carriage 10.

Figure 2:
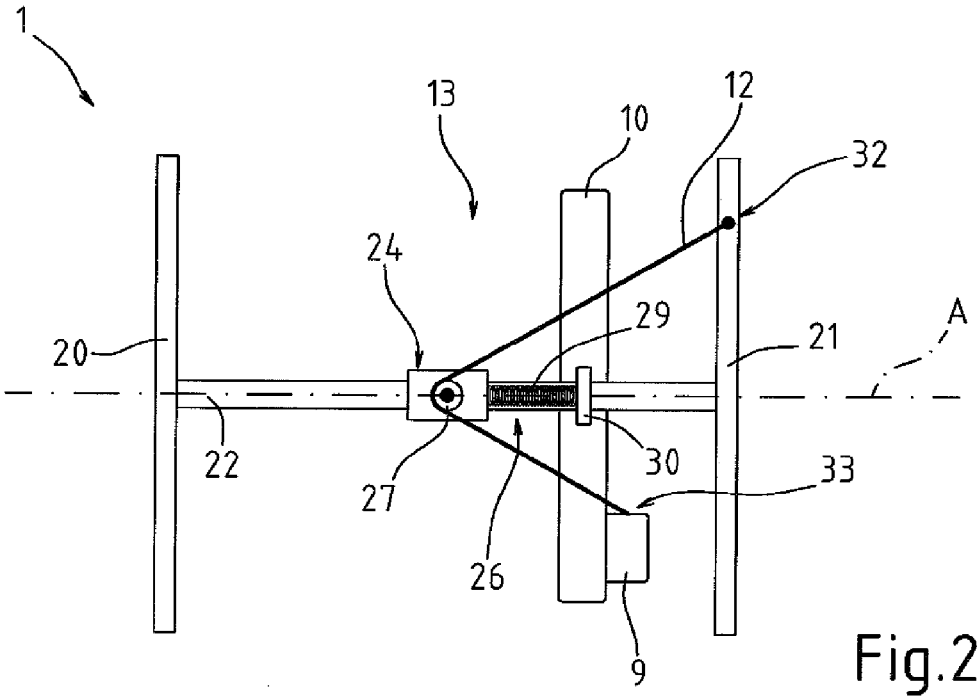
FIG. 2 is a diagrammatic side view, with parts removed for clarity, of the light fixture in FIG. 1.

With reference to FIG. 2, the compensation device 13 comprises a compensation carriage 24 and tensioning means 26.

The compensation carriage 24 is movable along a guide of frame 6 (e.g. along a side plate 22 which acts as a guide) and comprises a deviating member 27, preferably a pulley, adapted to be engaged by the power cable 12.

The tensioning means 26 are suitable to exert a force on the compensation carriage 24 such as to keep the electric cable 12, which engages the deviating member 27 of the compensation carriage 24, under tension.

In the case of the example illustrated in FIG. 2, the tensioning means 26 comprise a spring 29, the ends of which are arranged abutting against the compensation carriage 24 and against the resting base 30 integrally connected to the carriage 10, respectively.

In use, the power cable 12 extends between a fastening member 32 fixed onto the frame 6 and a fastening member 33 on the carriage 10, and engages the deviating member 27 of the compensation carriage 24.

Figure 3:
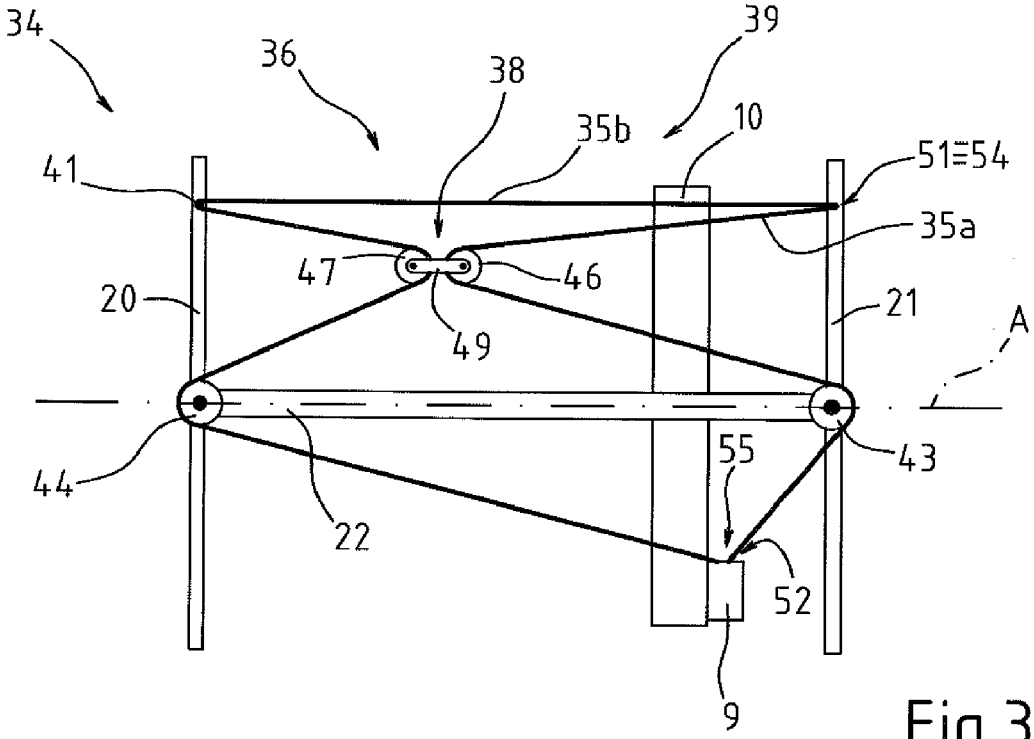
FIG. 3 is a diagrammatic side view, with parts removed for clarity, of a stage light fixture provided according to the present invention in accordance with a second embodiment in a first operating configuration.
Figure 4:
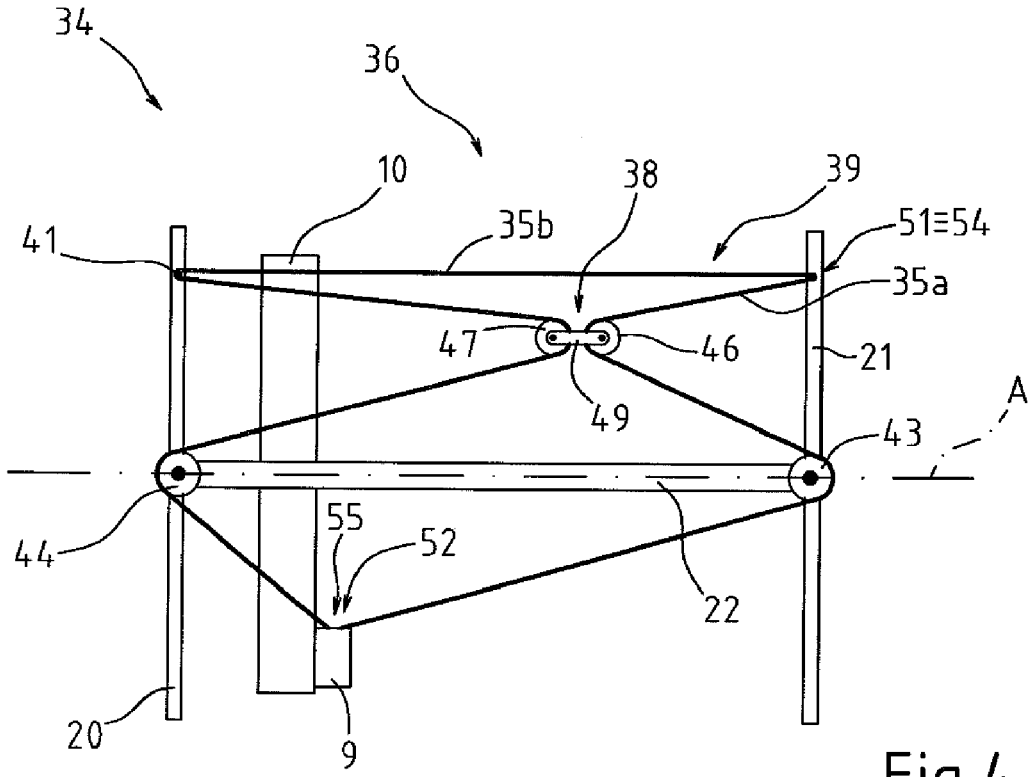
FIG. 4 is a diagrammatic side view, with parts removed for clarity, of the light fixture in FIG. 3 in a second operating configuration.

FIGS. 3 and 4 illustrate a second embodiment of a stage light fixture 34, in which the same reference numbers as in FIGS. 1 and 2 are used to indicate parts in common.

In practice, the light fixture 34 differs from the light fixture 1 substantially in that it comprises two power cables 35*a* and 35*b* suitable to power respective electric devices 9 (diagrammatically shown for simplicity in FIGS. 3 and 4 as a single member), and in that it comprises a different compensation device 36.

The power cables 35*a* and 35*b* comprise one or more electric conductors, electrically insulated from one another and suitable to power respective electric devices 9, respectively. In the case of the non-limiting example described and illustrated herein, each power cable 35*a* and 35*b* comprises four electric conductors, electrically insulated from one another and coupled to one another to form a conductive tape.

The compensation device 36 comprises a compensation carriage 38, tensioning means 39, a fixed deviating member 41, a fixed deviating member 43 and a fixed deviating member 44.

The compensation carriage 38 comprises a deviating member 46, preferably a pulley, suitable to be engaged by the power cable 35*a*, a deviating member 47, preferably a pulley, suitable to be engaged by the power cable 35*b*, and a connection plate 49 for connecting the deviating members 46 and 47.

The tensioning means 39 comprise the power cable 35*a*, which pulls the compensation carriage 38 so as to keep the power cable 35*b* under tension and the power cable 35*b*, which pulls the compensation carriage 38 so as to keep the power cable 35*a* tensioned according to the moving direction of carriage 10, respectively.

The fixed deviating member 41 is a deviating pin fixed to plate 20 and suitable to be engaged by the power cable 35*b*, for example.

The fixed deviating member 43 is a pulley fixed to plate 21 and suitable to be engaged by the power cable 35*b*, for example.

The fixed deviating member 44 is a pulley fixed to plate 20, under the deviating pin 41, and suitable to be engaged by the power cable 35*b*, for example.

In use, the power cable 35*a* extends between a fastening member 51 on frame 6 and a fastening member 52 on carriage 10, thus sequentially engaging the deviating member 46 on the compensation carriage 38 and the fixed deviating member 43. On the other hand, the power cable 35*b* extends between a fastening member 54 on frame 6, in this case coinciding with the fastening member 51 on frame 6 of the power cable 35*a*, and a fastening member 55 on carriage 10, thus sequentially engaging the fixed deviating member 41, the deviating member 47 of the compensation carriage 38, and the fixed deviating member 44.

In use, a movement of carriage 10 along the axis A determines, under the bias of the tensioning means 39 of the compensation device 36, a consequent movement of the compensation carriage 38 in a direction opposite the movement direction of carriage 10. The movement of the compensation carriage 38 is clearly visible when carriage 10 passes from the proximal position (configuration shown in FIG. 3) to the distal position (configuration shown in FIG. 4).

Thereby, the power cables 35*a* and 35*b* remain always tensioned and do not obstruct the movement of carriage 10.

Figure 5:
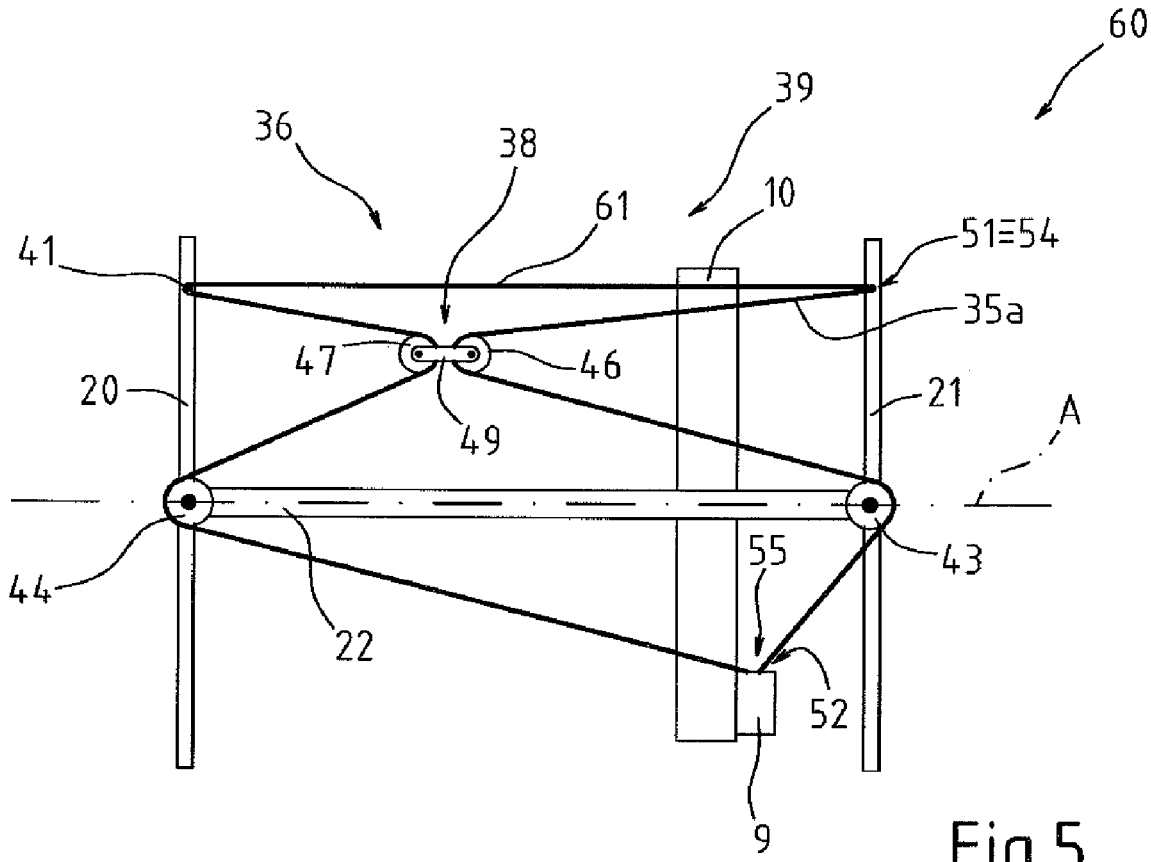
FIG. 5 is a diagrammatic side view, with parts removed for clarity, of a stage light fixture provided according to the present invention in accordance with a third embodiment.

FIG. 5 illustrates a third embodiment of a stage light fixture 60, in which the same reference numbers as in FIGS. 4 and 2 are used to indicate parts in common.

In practice, the light fixture 60 substantially differs from the light fixture 34 in that the second power cable 35*b* is replaced by a tensioning belt 61.

In a variant (not shown) of the embodiment in FIGS. 3 and 4, the tensioning belt replaces the first power cable 35*a* of the light fixture 34.

It is finally apparent that changes and variations may be made to the light fixture 1, 34, 60 and to the method described herein, without departing from the scope of the appended claims.

The invention claimed is:

1. A stage light fixture comprising:

a main body extending along a longitudinal axis;

a light source arranged inside the main body at a first end of the main body and suitable to emit a light beam substantially along the longitudinal axis;

an objective lens arranged at a second end of the main body;

light beam adjusting means, which are arranged between the light source and the objective lens for intercepting the light beam;

a frame;

a carriage, which is movable with respect to the frame along the longitudinal axis of the main body and supports the light beam adjusting means;

at least a first power cable to power at least a first electric device mounted on the carriage; and a compensation device suitable to keep the first power cable under tension for each working position of the carriage.

2. The stage light fixture according to claim 1, wherein the compensation device comprises a compensation carriage and tensioning means; the compensation carriage being movable with respect to the frame and to the carriage and being engaged by the first power cable; the tensioning means being suitable to exert a force on the compensation carriage so as to keep the first power cable under tension.

3. The stage light fixture according to claim 2, wherein the compensation carriage comprises at least a first deviating member engaged by the first power cable.

4. The stage light fixture according to claim 2, wherein the tensioning means comprise a tensioning belt which engages the compensation carriage and is suitable to pull the compensation carriage so as to keep the first power cable under tension.

5. The stage light fixture according to claim 4, wherein the compensation carriage comprises a second deviating member engaged by the tensioning belt.

6. The stage light fixture according to claim 2, wherein the tensioning means comprise a spring.

7. The stage light fixture according to claim 2, further comprising a second power cable to power at least a second electric device mounted on the carriage; the first power cable extending along a first path between a first fastening member on the frame and a second fastening member on the carriage and the second power cable extending along a second path between a third fastening member on the frame and a fourth fastening member on the carriage; the compensation carriage being engaged by the first and the second power cable; the tensioning means comprising the first power cable, suitable to pull the compensation carriage so as to keep the second power cable under tension, and respectively the second power cable, suitable to pull the compensation carriage so as to keep the first power cable under tension on the basis of the moving way of the carriage.

8. The stage light fixture according to claim 7, wherein the compensation carriage comprises a first deviating member engaged by the first power cable and a second deviating member engaged by the second power cable.

9. The stage light fixture according to claim 8, wherein the compensation device comprises a first fixed deviating member on the frame suitable to be engaged by the first power cable.

10. The stage light fixture according to claim 9, wherein the compensation device comprises a second fixed deviating member on the frame and a third fixed deviating member on the frame, which are suitable to be engaged by the second power cable.

11. The stage light fixture according to claim 7, wherein the first fastening member on the frame and the third fastening member on the frame are coincident.

12. A method for controlling a stage light fixture provided with a main body extending along a longitudinal axis, the method comprising:

moving a carriage with respect to a frame of the main body along the longitudinal axis of the main body;

powering at least a first electric device mounted on the carriage by means of at least a first power cable; and keeping the first power cable under tension.

* * * * *